US005286026A

United States Patent [19]

Schnapp

[11] Patent Number: 5,286,026

[45] Date of Patent: Feb. 15, 1994

[54] PUZZLE COMPOSED OF CONCENTRIC RINGS

[76] Inventor: Abrahm Schnapp, 28 Yaffo Street, Haifa, Israel

[21] Appl. No.: 853,038

[22] Filed: Mar. 17, 1992

[51] Int. Cl.[5] ..... A63F 9/08

[52] U.S. Cl. ..... 273/155; 273/157 R

[58] Field of Search ..... 273/155, 142 HA, 157 R, 273/153 S; 434/174, 198, 404

[56] References Cited

U.S. PATENT DOCUMENTS 3,596,380 8/1971 Williams ..... 273/155

FOREIGN PATENT DOCUMENTS 508727 6/1955 Italy ..... 273/155

2153691 8/1985 United Kingdom ..... 273/155

OTHER PUBLICATIONS

"Games", Wheel Trouble, Mar. 1966, p. 49.

*Primary Examiner*—V. Millin

*Assistant Examiner*—William M. Pierce

*Attorney, Agent, or Firm*—Frishauf, Holtz, Goodman & Woodward

[57] ABSTRACT

A puzzle in the form of a flat, circular plate is composed of a plurality of concentric rings, wherein each ring contains numerals, symbols or parts of pictures on its front and on its rear surface. These have to be arranged in a given order on the plate by rotation and/or reversal of each ring. In the case of pictures the parts on each ring have to be assembled to form one or more complete pictures, and in the case of numerals into a given arrangement or sequence of figures. Each ring is provided with a circumferential groove and with protruding knobs engaging with the groove of the adjoining ring whereby the rings are maintained in a common plane of the circular plate.

12 Claims, 6 Drawing Sheets

PUZZLE COMPOSED OF CONCENTRIC RINGS

The invention relates to various embodiments of a puzzle to be solved by children of different ages as well as by adults, in accordance with the grade of difficulty and the rules to be followed.

The puzzle according to the invention comprises a flat, circular plate composed of a plurality of concentric rings of increasing diameter; each ring is rotatable in relation to the remaining rings, by means of a circumferential groove provided along its periphery and two pins disposed in opposite alignment on the inside circumference of each ring engaging with the groove of the next-smaller ring. The assembly of the plate from the said rings is carried out by placing the pins of the larger ring into the peripheral groove of the next smaller ring and swinging the larger ring about an angle of 90° into the plane of the smaller ring. In order to keep the rings in flat alignment, at least one smooth boss or knob is provided on the inside circumference of each ring in a place between the two pins, preferably at right angles to the position of the pins, which will slip into the groove owing to the elasticity of the ring material.

In an embodiment of the puzzle to be played by small children, the front and/or rear of the rings is decorated by sections of pictures which, after correct assembly, i.e. after repeated rotation of several or all rings, will result in one or more complete pictures of objects, such as fruits or the like. In an embodiment for older children it is the task to assembly the rings in such a manner that complete pictures of fruit or the like appear on both sides of the assembled plate, which requires correct placing of the right side of each ring during assembly by means of the grooves and pins.

In still another embodiment destined for older children or adults each ring contains, on both the front and the rear surface, several imprints of the same numeral in random distribution:- for instance each of the ten rings of a puzzle will carry one of the numerals from "1" to "10", starting from the inside to the outside or vice versa. It is the task to assemble the rings in such a manner that the numerals on both the front and the rear are arranged in a consecutive radial row each. Since the numerals are randomly placed, there is the difficulty to assemble the rings with the correct side to the front and to the rear. Of course, during manufacture of the puzzle the numerals must be so positioned so that there is one and only one possible solution.

A somewhat easier puzzle contains consecutive numerals on both sides of the rings, for instance the numbers 1 to 10 on one side and the numbers of 11 to 20 on the other side. In this puzzle there is no diffculty in arranging the rings right side up, and the only task is to arrange the numerals in radial rows, i.e. from 1 to 10 on one side and from 11 to 20 on the other.

The puzzle can also serve for advertizing purposes, by printing letters on the rings , which may be the same or different on both sides, front and rear, which can be assembled in the same way as in the aforedescribed puzzles and will result in the name of a product, a company or any other object to be advertized. Also in this kind of puzzle it should be the task to arrange the letters in radial rows on both sides of the assembled circular plate.

In order to facilitate assembly of the rings instead of by insertion of the two pins into the appropriate groove, especially if the puzzle is destined for smaller children, each ring is provided along its circumference with a groove and on its inside with at least three low knobs or bosses. The child assembles the plate by positioning one ring onto the next largest ring and pressing it down until the knobs snap into the groove of the next ring due to the elasticity of the material. The knobs now keep the rings in position, until the last ring has been assembled, and allow rotation of the individual rings without the plate breaking apart.

The same effect can be obtained by providing a groove along the inside of each ring and providing at least three knobs or bosses on the periphery. The assembly is identical:—the child may start from the smallest or from the largest ring and continue placing the other rings into or around the ring on the table or tray until the entire plate is assembled.

In both cases, i.e. whether the groove is on the inside or along the periphery of each ring, the puzzle contains either pictures, numerals or letters as described in respect of the rings provided with opposed pins. Also in these embodiments the player has to find the correct position of each ring by reversing it onto the other side, if necessary, and to arrange the symbols in a radial row by rotating each ring until the task is completed.

SHORT DESCRIPTION OF THE DRAWINGS

FIG. 1 is a plan view of one side of the puzzle in the form of a circular plate having its rings positioned in random order, FIG. 2 is a plan view of the puzzle shown in FIG. 1, having its rings assembled in proper order to show two rows of apples, FIG. 3 is a central section through the puzzle of FIGS. 1 and 2 showing its assembly from several concentric rings, FIG. 4 is an enlarged section of the portion encircled by arrows 4—4 of FIG. 3, FIG. 5 is a plan view of one ring of the puzzle showing the groove as well as the pins and the bosses on its inner circumference, FIG. 6 is a section along line I-II-III of FIG. 5, FIG. 7 shows the assembly of two rings, FIG. 8 shows the front side of a puzzle having the rings provided with consecutive numerals, which are arranged in one radial row, FIG. 9 shows the rear side of the puzzle of FIG. 8 wherein the numerals are still in random order.

DETAILED DESCRIPTION OF THE DRAWINGS

Figure 1:
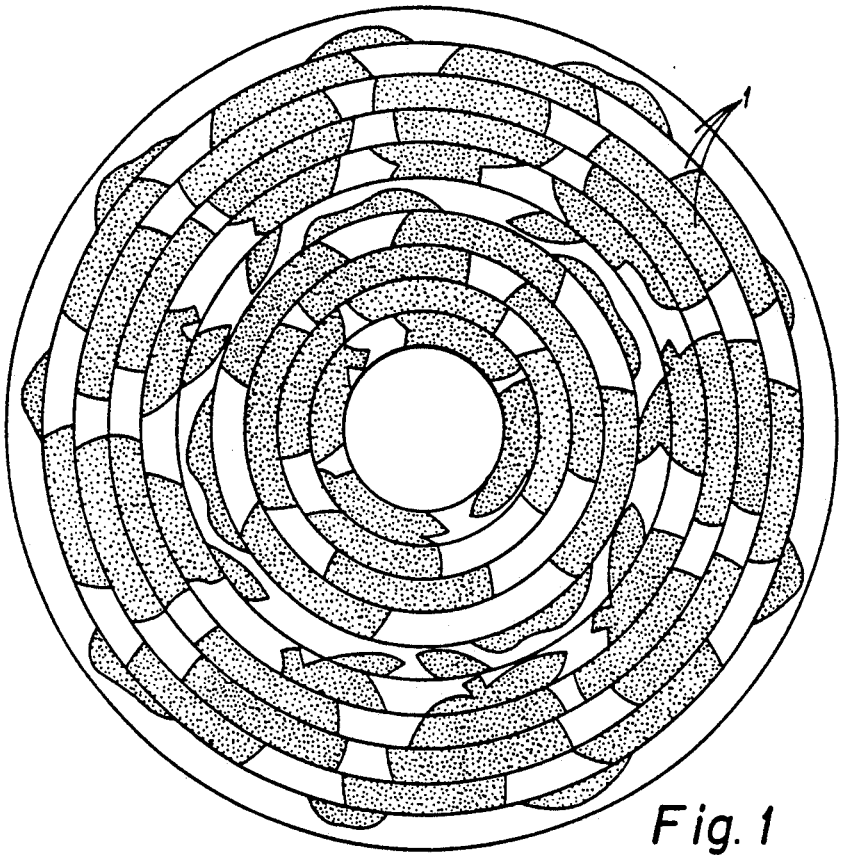
Figure 3:
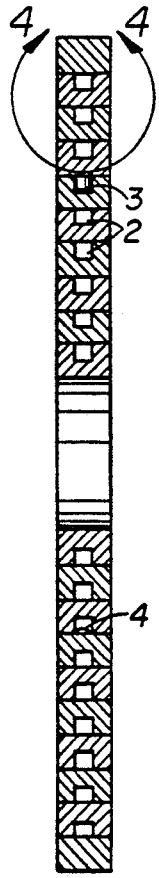
Figure 2:
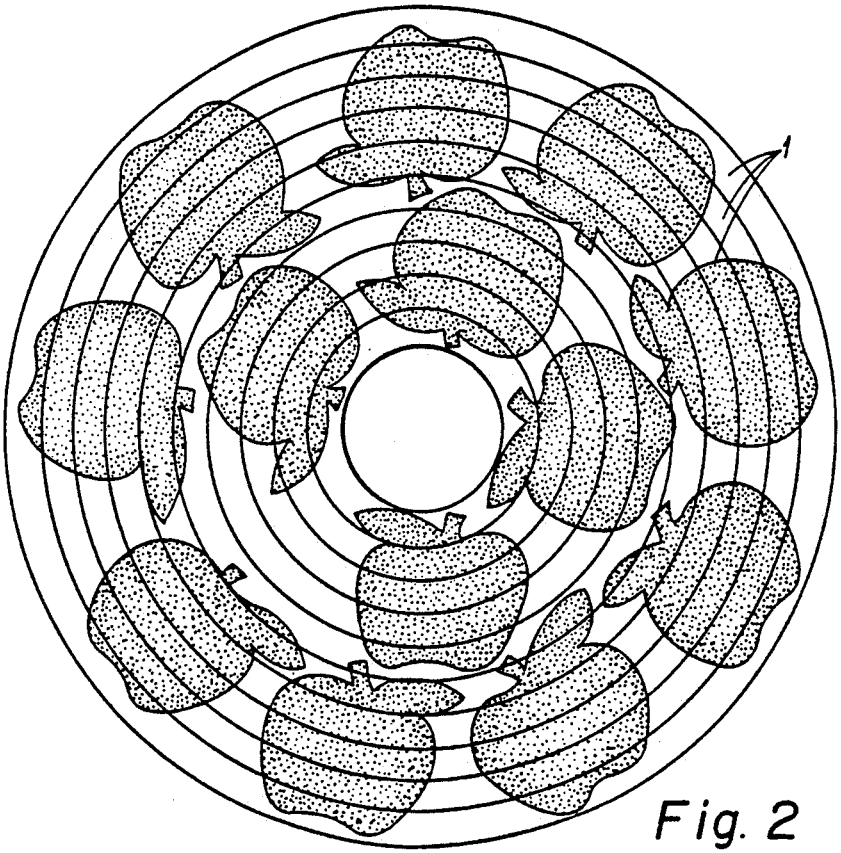
Figure 4:
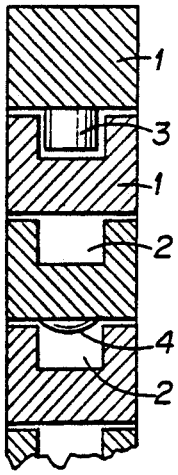

FIGS. 1 through 4 show a simple embodiment of the puzzle, which is composed of ten concentric rings 1, each ring being separately rotatable. FIGS. 3 and 4 show that each ring is recessed on its periphery by a circumferential groove 2 and has two cylindrical, inwardly protruding pins 3 on its inner periphery in opposed alignment which engage with the groove of the next smaller ring. At least one knob or boss 4 is positioned on the inner periphery of each ring, likewise engaging with the groove, with the purpose of keeping the rings in a plane in correctly assembled state. FIG. 1 shows the circular plate after its assembly from initially separate rings, but in random order, while FIG. 2 shows it after the rings have been rotated and shifted until a complete picture of two rows of apples has been achieved. This type of puzzle is suitable for relatively small children.

For older children, or even adults, the same assembly of objects, such as apples, is applied to the rear side of the rings as well. The puzzle is offered to the person in disassembled state, and it is now the task to assemble the rings in the form of a circular plate in the way as will be explained with reference to FIGS. 5, 6 and 7 of the drawings. The additional difficulty lies in the fact that both sides of the rings contain parts of the same or similar objects, such as for instance apples, and that the rings are to be assembled in such a way that each side will produce a perfect picture. This will require a large amount of turning several rings from front to rear and vice versa, until both pictures are right side up.

Figure 5:
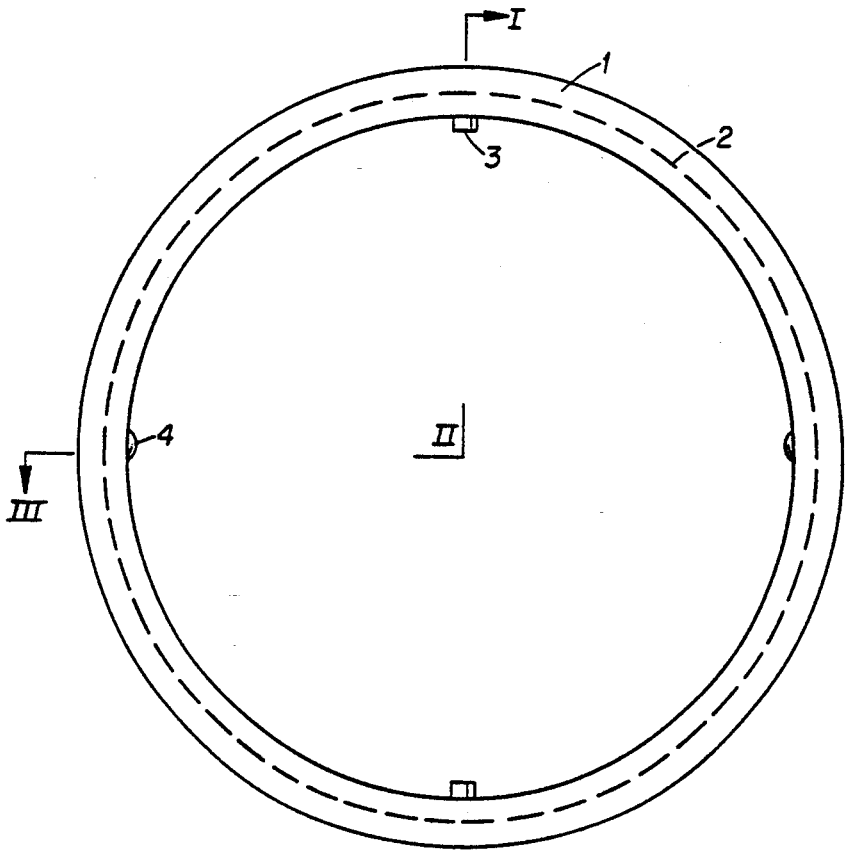
Figure 6:
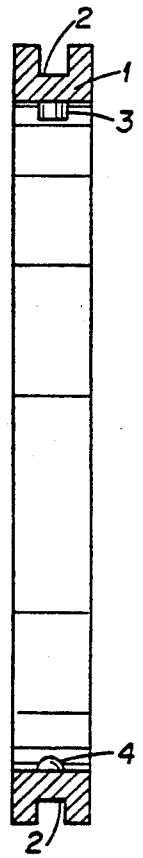
Figure 7:
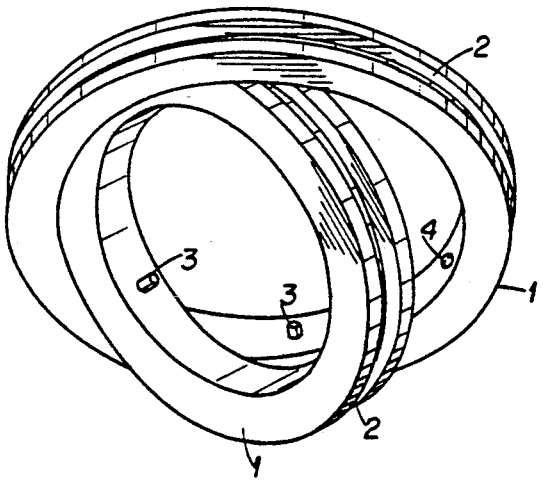

FIGS. 5 and 6 show one of the rings in plan view and in section showing the groove 2 and the pins 3 as well as the bosses 4. It can further be seen that the numeral 8 is printed on the front of the ring in random distribution, while its rear probably carries the numeral 18 in random, but different distribution. The assembly of one ring over the next smaller ring is shown in FIG. 7: The larger ring is pushed over the smaller one at about a right angle and the pins 3 are inserted into the groove 2. As soon as the pins are in the groove the larger ring is turned into the plane of the smaller ring until the knob or boss 4 snaps into the groove, thus holding the two rings in the same plane.

In the foregoing the pins 3 have been shown and described to be of cylindrical shape, but it will be understood that they may have other shapes suitable for insertion into the grooves, such as frusto-conical or in the form of a cylinder provided with a spherical end.

Figure 8:
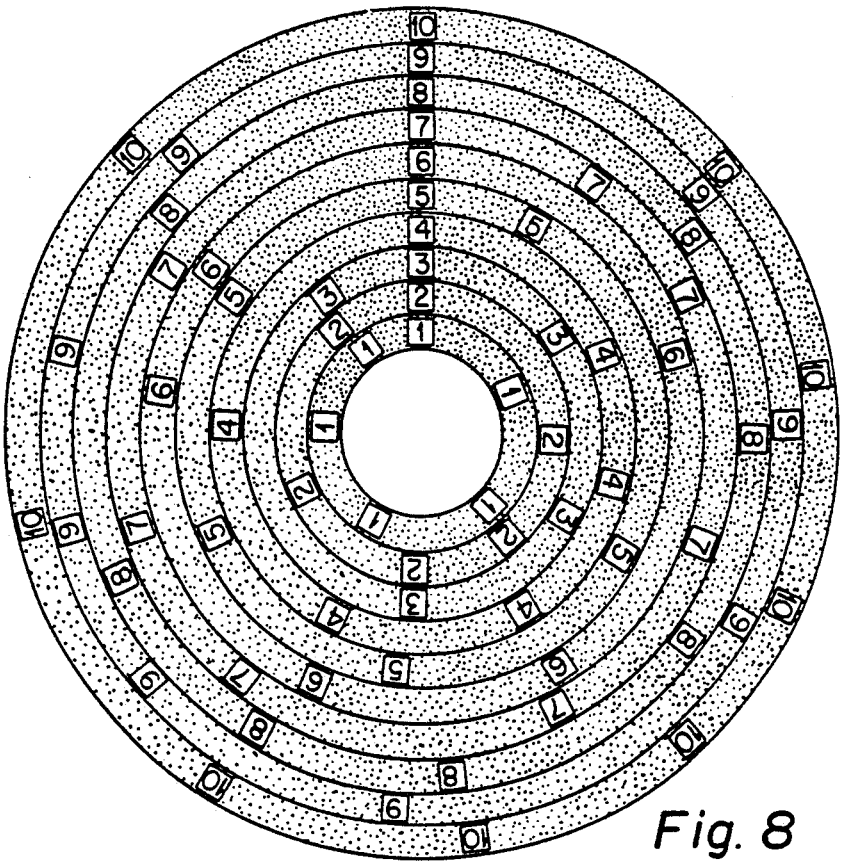
Figure 9:
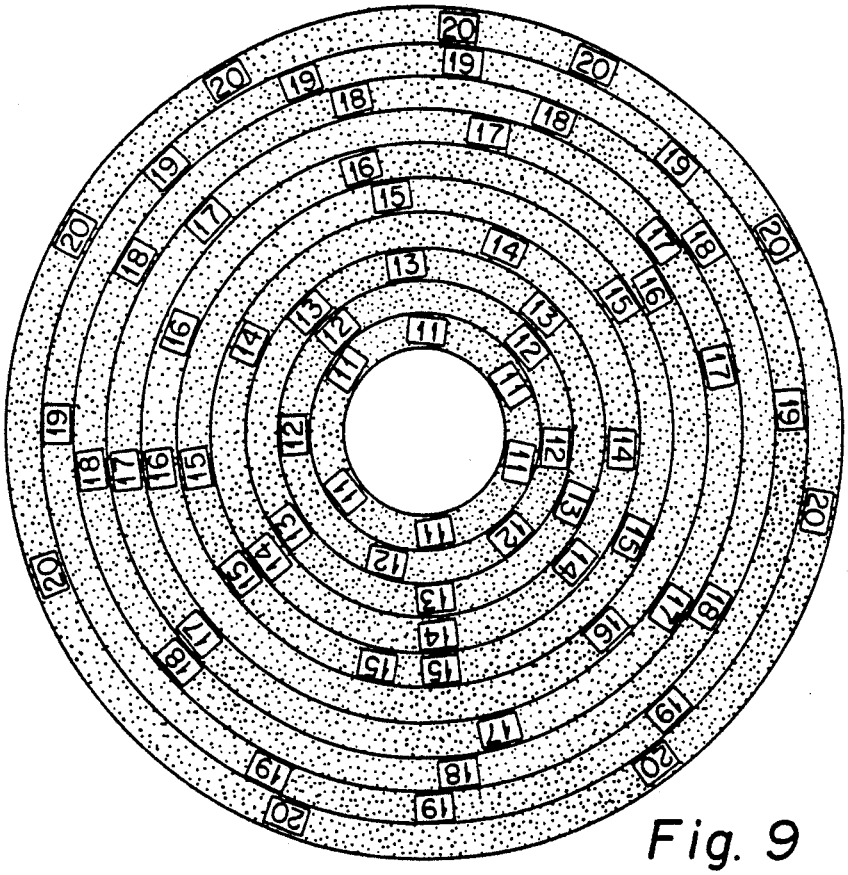

Finally FIGS. 8 and 9 show both sides of a puzzle containing the numerals 1 to 20 on its respective sides. Here again, the rings have to be rotated until the numbers 1 to 10 appear in a single row on one side, and the numbers 11 to 20 on the other side. As can be seen. this has been accomplished as shown in FIG. 8, but not on the rear side shown in FIG. 9.

A still more difficult embodiment would contain the numerals 1 to 10 on both sides, whereby it is not known which is the front and the rear, and the assembly is becoming still more difficult, requiring frequent reversal of one or more rings.

Figure 10:
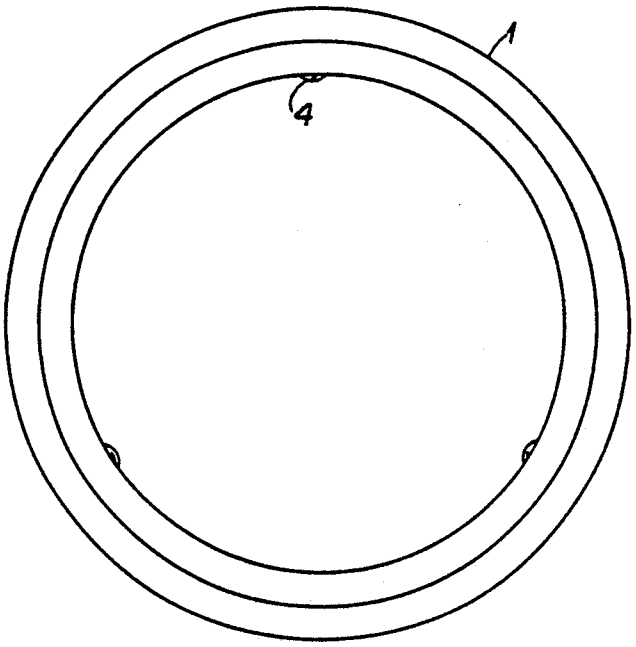
FIG. 10 is a plan view of two assembled rings each containing a peripheral groove and three knobs on its inside.
Figure 11:
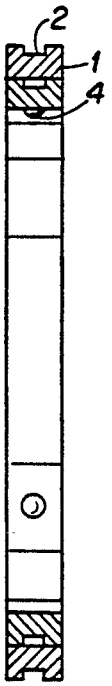
FIG. 11 is a section through the two rings shown in FIG. 10.

A simpler mode of assembly is made possible by the embodiment shown in FIGS. 10 and 11. Herein the pins are omitted altogether and replaced by three (or more) knobs 4 which protrude very little beyond the plane of the ring. The assembly is made by placing either the largest or the smallest ring on the table or tray, placing the next ring above the first ring and pressing it down until the knobs 4 snap into the groove 2, which is enabled due to the elasticity of the rings. After the two first rings have been assembled the rest are assembled in the same manner, until the entire plate is formed. Only now starts the task of creating the figures, letters or pictures by rotating and/or reversing every ring into the correct position.

Figure 12:
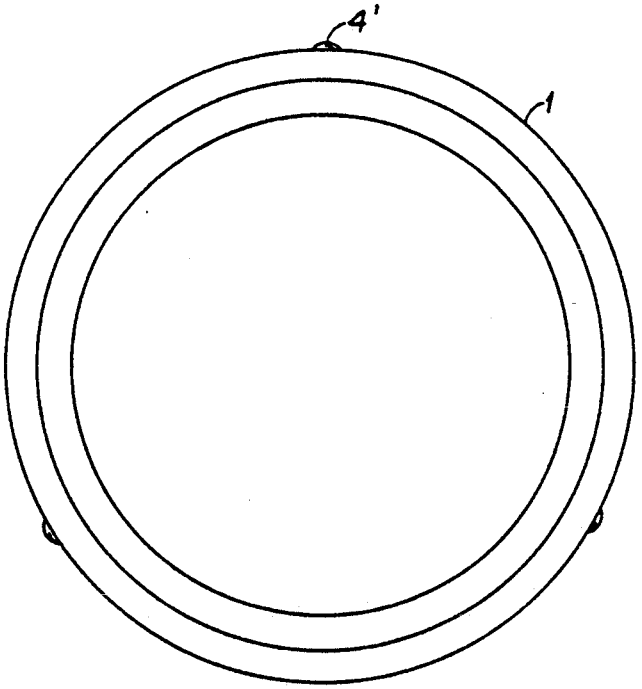
FIG. 12 is a plan view of two assembled rings each containing a groove along its inside and three knobs on its outside.
Figure 13:
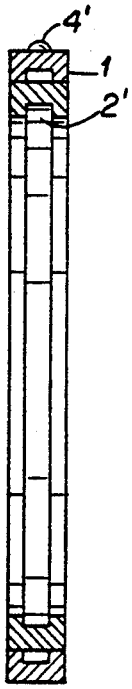
FIG. 13 is a section through the two rings shown in FIG. 12.

FIGS. 12 and 13 show similar rings as in the former figures, but with the difference that the position of the grooves 2' and knobs 4' has been reversed, i.e. that the groove 2' is on the inside, while the knobs are on the outside of each ring. The assembly is identical with that described in respect of the rings having grooves on the outer periphery.

As said in the beginning, many kinds of pictures, symbols, numerals or letters may be applied to one or both sides of the circular plate formed of several rings, in accordance with the grade of difficulty of the game, which could be played by toddlers, older children and by adults.

Figure 14:
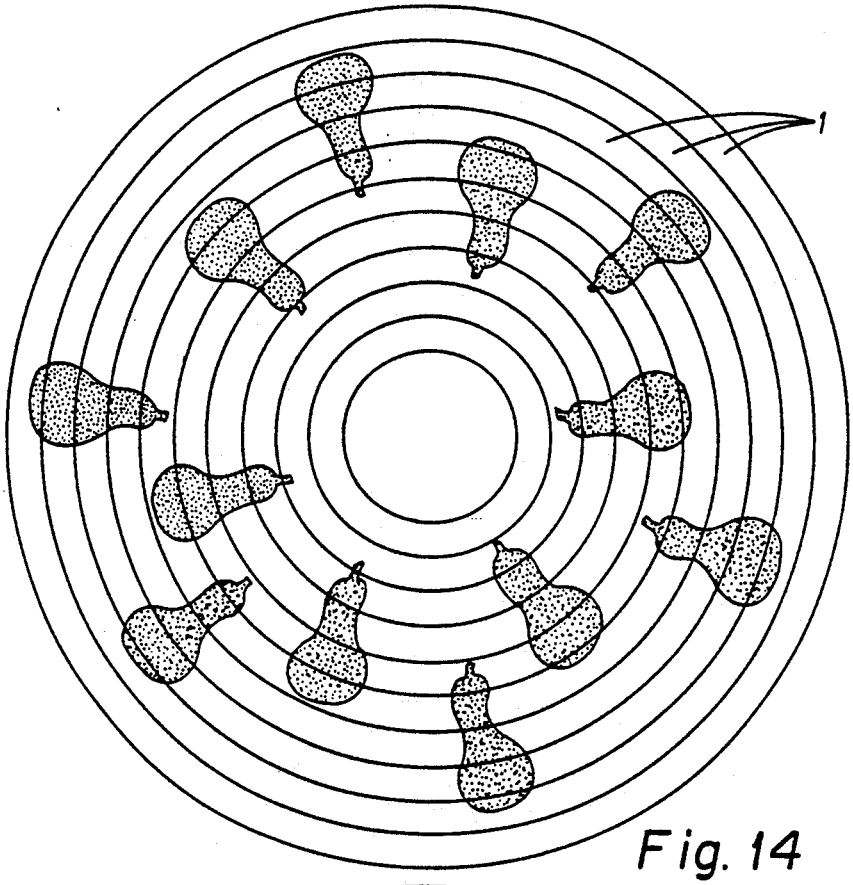
FIG. 14 is a plan view of the reverse side of the puzzle shown in FIG. 2.
Figure 15:
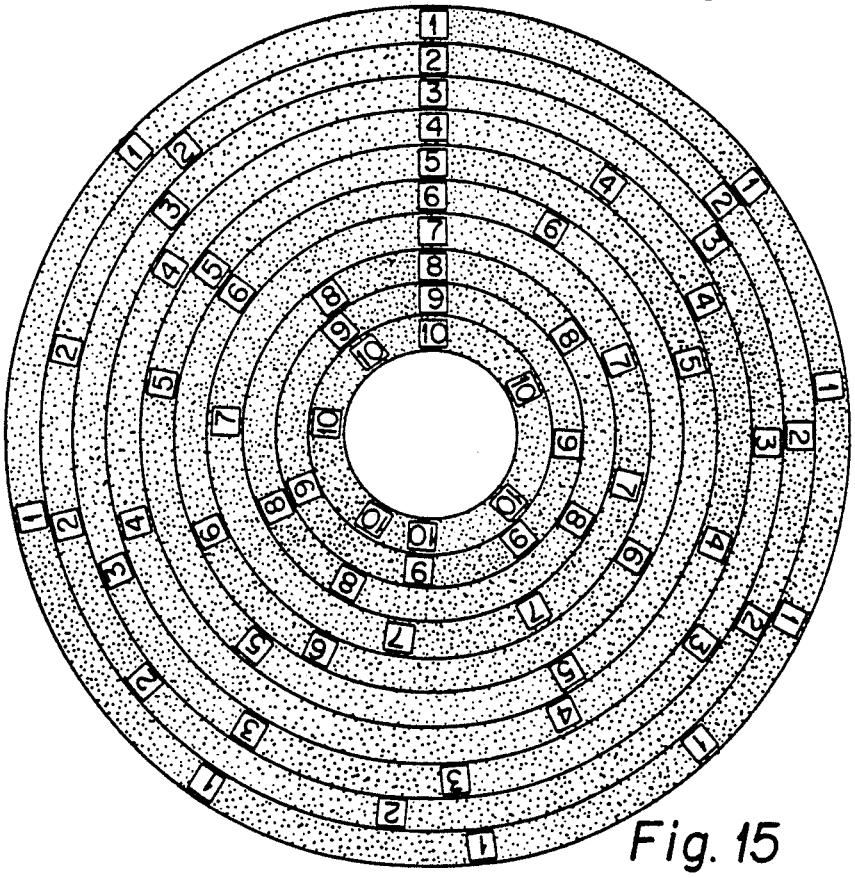
FIG. 15 is a plan view of the rear side of the puzzle of FIG. 8 according to another embodiment of the invention.

Instead of identical or similar pictures of different objects the puzzle may likewise contain pictures of different objects such as fruit or animals, which, of course would facilitate solving of the puzzle. Thus, where the same picture is on both sides, for example, the apples of FIG. 2 would be shown in an identical manner on the front and rear sides of the puzzle. However, a different picture can be shown on the rear side, for example, by the different pear fruit shown in FIG. 14 or the reversal of the numbers as shown in FIG. 15.

Figure 16:
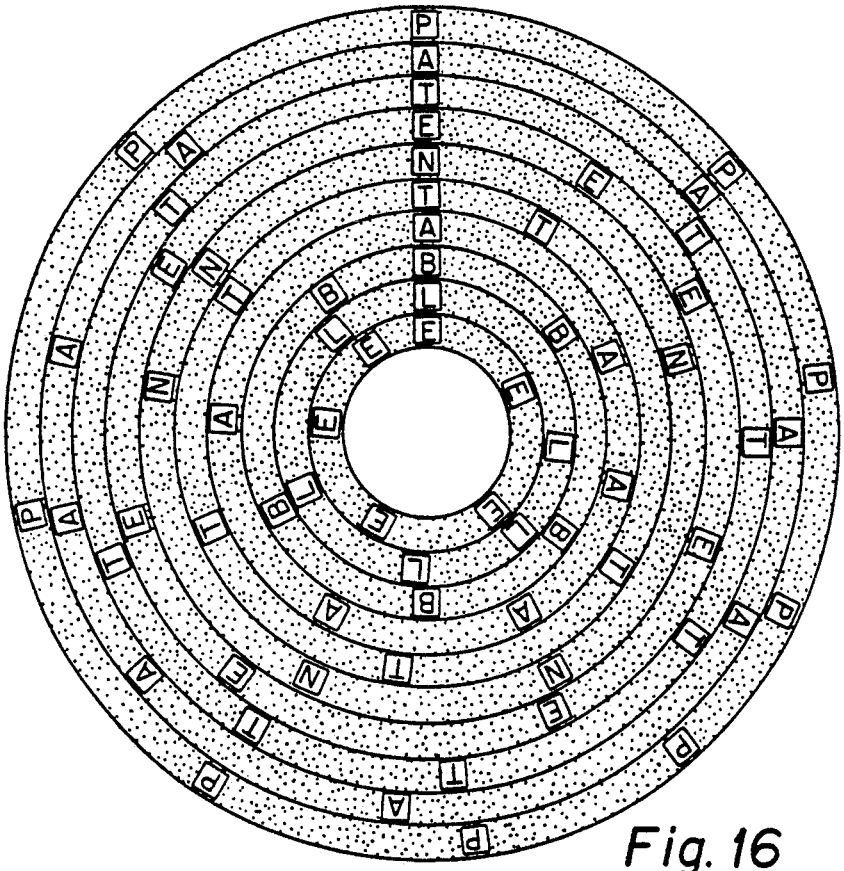
FIG. 16 is a plan view of the front side of a puzzle according to another embodiment of the invention.
Figure 17:
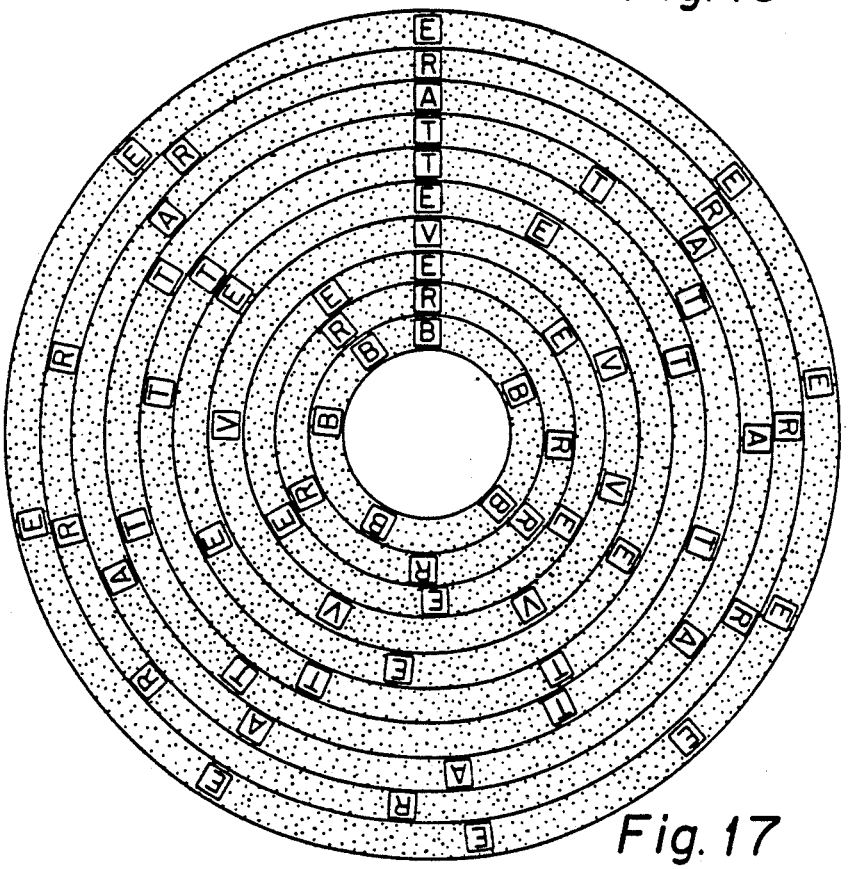
FIG. 17 is a plan view of the rear side of the puzzle of FIG. 16.

Another modification, as shown in FIGS. 16 and 17, designed for advertizing purposes, will have one side of the rings printed with letters which form a word or motto in one language, while the other side of the rings contains a word or motto in another language. As an example, one side could contain English letters and the other Greek or Hebrew letters, each side forming a suitable motto for advertizing a product. The phrase in FIG. 17 is in Italian.

The puzzle is not limited to the ten rings shown in the drawings, and it is obvious that more or less rings than ten may be chosen to form the circular plate, again according to the desired grade of difficulty.

I claim:

1. A puzzle comprising a plurality of initially separate, concentric planar rings of stepped increasing size arrangeable together in the form of a flat circular plate having a center, said plate having a front surface and a rear surface and each said ring including:

an obverse planar surface, a reverse planar surface, the obverse and the reverse planar surfaces of each said ring having visual information imprinted thereon such that a visual pattern comprised of combinations of said visual information from said rings is formed on said plate when said rings are arranged in a predetermined order relative to each other by at least one of rotation and reversal of said rings relative to each other, an inner circumference, an outer periphery contiguous with the inner circumference of a next larger ring, a circumferential groove on the outer periphery, two pivot pin means on the inner circumference in diametrically opposed alignment with each other for pivotal connection to a next smaller ring, said obverse and said reverse surfaces of each said ring being pivotally reversible with respect to said front and rear surfaces of said plate by pivotal rotation about said pivot pin means, and at least one knob means for releasably retaining each said ring in parallel relation to said plate and for permitting rotation of each said ring relative to other said rings of said plate about the center of said plate, said at least one knob means being positioned on the inner circumference in cooperating relation with said circumferential groove of the next smaller ring, wherein assembly of said plate from said rings is made by placing said pins of a larger ring in the circumferential groove of the next smaller ring, while the planar surfaces of said larger ring and said next smaller ring are positioned substantially at right angles to each other, and by rotating and urging said larger ring into the plane of said next smaller ring, whereby said at least one knob means of said larger ring snaps into said circumferential groove of said next smaller ring due to elasticity of said larger ring, thereby positioning the obverse surfaces of said larger ring and said next smaller ring in an identical plane.

2. The puzzle as defined in claim 1, wherein said pivot pin means are of cylindrical shape coextensive with a size of said circumferential grooves.

3. The puzzle as defined in claim 1, wherein said inner circumference of each said ring has an inner surface and said knob means protrude slightly above the inner surface of the inner circumference in smooth transition to effect ready insertion into said groove of the next smaller ring.

4. The puzzle as defined in claim 1, wherein both the front surface and the rear surface of said plate are imprinted with a plurality of objects of substantially similar shape as said visual pattern.

5. The puzzle as defined in claim 1, wherein the front surface and the rear surface of said plate are imprinted with different kinds of objects as said visual pattern.

6. The puzzle as defined in claim 1, wherein the obverse surface and the reverse surface of each ring are each imprinted with a plurality of a given numeral in random distribution as said visual information, and said visual pattern includes at least one radial arrangement of said numerals on each surface of said flat plate, by at least one of rotating and reversing any number of rings.

7. The puzzle as defined in claim 1, wherein the obverse surface of each said ring is imprinted with a numeral different from a numeral imprinted on the reverse surface of said ring, and said visual pattern includes at least one radial arrangement of said numerals on each surface of said plate.

8. The puzzle as defined in claim 1, wherein the obverse surface and the reverse surface of each said ring are each imprinted with a plurality of a given letter in random distribution as said visual information, and said visual pattern includes at least one radial row of words on each surface of said plate, by at least one of rotating and reversing any number of rings.

9. The puzzle as defined in claim 1, wherein the obverse surface of each said ring is imprinted with a plurality of a letter in one language and the reverse surface of each said ring is imprinted with a plurality of a letter in another language, each letter being arranged on each said ring in random distribution.

10. The puzzle as defined in claim 1, wherein said visual pattern is selected from the group consisting of pictures, symbols, numerals and letters.

11. The puzzle as defined in claim 1, further comprising an outermost concentric planar ring having a groove-less outer periphery.

12. The puzzle as defined in claim 1, further comprising an innermost concentric planar ring having a pivot pin-less inner circumference.

* * * * *